US005487601A

United States Patent [19]

Lucardie

[11] Patent Number: 5,487,601

[45] Date of Patent: Jan. 30, 1996

[54] BASEBALL CARD STORAGE AND PROTECTION DEVICE

[76] Inventor: John F. Lucardie, 713 San Antonio Dr., Covina, Calif. 91723

[21] Appl. No.: 98,954

[22] Filed: Jul. 28, 1993

[51] Int. Cl.[6] ..... A47B 63/00

[52] U.S. Cl. ..... 312/183; 211/51

[58] Field of Search ..... 312/205, 190, 312/183, 185; 211/51, 71, 69

[56] References Cited

U.S. PATENT DOCUMENTS

| | | | |
|---|---|---|---|
| 92,141 | 7/1869 | Amberg | 211/51 |
| 571,041 | 11/1896 | Dickinson | 211/51 |
| 3,069,215 | 12/1962 | Dodge | 312/190 |
| 3,168,198 | 2/1965 | Shelley | 312/71 |
| 3,402,923 | 9/1968 | Rhoads et al. | 312/71 |
| 3,953,090 | 4/1976 | Fuchs | 312/190 |
| 4,106,668 | 8/1978 | Gebhardt et al. | 312/71 |
| 4,838,436 | 6/1989 | Bailey | 211/51 |

*Primary Examiner*—Kenneth J. Dorner
*Assistant Examiner*—Gerald A. Anderson

[57] ABSTRACT

A simple, light-weight device consisting of a minimal number of parts, made from injection molded polyethylene or other lightweight, inexpensive material, which fits inside a standard cardboard box of 4.00×2.75 inches high of varied length. The device, having two end plates (10A and 10B) which can be pulled apart or put close together, is used to protect Baseball cards, measuring 3.5×2.5 inches, from getting damaged when they are loosely transported or stored inside the standard cardboard box. This is accomplished when the two end plates (10A and 10B) in their extended positions are pressing on one side against the inside wall of a standard box and at the other side against a pack of cards. The holding force of the two end plates (10A and 10B) is maintained by a series of molded bubbles and recesses or notches at the inside walls of poly-ethylene parts of a main connector tube (14), which connects two end plates (10A and 10B) at the center of said plates and of said device.

1 Claim, 2 Drawing Sheets

BASEBALL CARD STORAGE AND PROTECTION DEVICE

BACKGROUND

1. Field of the Invention

This invention relates to the field of Novelties in General and more particularly to that of the collection of baseball cards as a hobby and more specifically to a novel useful device to protect baseball cards from getting damaged during storage.

2. Description of Prior Art

The hobby of collecting baseball cards is not a new hobby. However, the hobby has of late become immensely popular and turned into a formidable business. Collectors, young and old, are joining the ranks of serious baseball collectors everyday. As hobbyists or serious long-term investors, pretty much like stamp collectors. According to official figures there are approx. 15 million serious collectors of baseball cards in the USA alone. Baseball cards normally measure 3.5×2.5 inches. They are tough, thin cards, made of a sturdy type of cardboard and have glossy printing on both sides, depicting a photograph of baseball or other famous sports stars with their statistics, records and accomplishments. Baseball cards are normally carried and stored in a rigid cardboard box,which comes in different sizes,ranging from a 200-card box to a 960 card box, measuring 4×2.75 inches high with varied lenghts. In almost all cases collectors never buy a full box of cards. They buy a few packs, carry these home and store these in one of the standard card boxes mentioned above. Consequently, many times the cards are not transported packed together vertically as in a full box, but are laying flat on the bottom of the box and are able to move around, where they can cause friction and easily be damaged. As the cards are continuously increasing in value, the serious collectors/investors are realizing this and are protecting their valuable cards in various ways. At first by trying to put enough cards in the box to have a full box, by using paper napkins and the like, to protect the cards from getting damaged inside the standard boxes. The standard boxes are also perfect and convenient in size to carry the cards to card fairs and conventions because they are easy to use and handle. In the present invention, the inventor has attempted to rectify this situation and has tried to come up with a device to prevent this damage to the cards. The inventor has also searched the market for any Prior Art in the hobby-field of baseball card collecting and has come to the conclusion that there is NO PRIOR ART as to any of such a device being in existence on the market today.

OBJECTS AND ADVANTAGES

There are several objects and advantages in the present invention of the said novel device:

a) to provide a device which will allow the baseball cards to be stored in a vertical position and will keep them closely packed together.

b) to provide a device, which would not allow the cards to move around in a standard size box so that they could be easily damaged with the result of a considerable loss in value.

c) to provide a device, which will eliminate the necessity of having the various sizes of standard boxes for storage and transportation. One standard box will be sufficient. The undersigned inventor is of the opinion that the largest standard card box would be the most suitable box due to it's convenient size.

d) to provide a device, which would offer the serious collector to have all boxes of the same size for storage in a bigger box container

DRAWING FIGURES

The drawing figures are presented in two sheets numbered from 1 to 2, comprising altogether 6 Figures. In the drawings, the two important elements of the device, the two end plates, have the same number, but a different alphabetic suffix.

REFERENCE NUMERALS IN DRAWINGS

10A End plate

10B End plate

12 Main plate connector

14 Telescoping tube guides.

DESCRIPTION- DRAWING FIGS. 1 THROUGH 6

Figure 1:
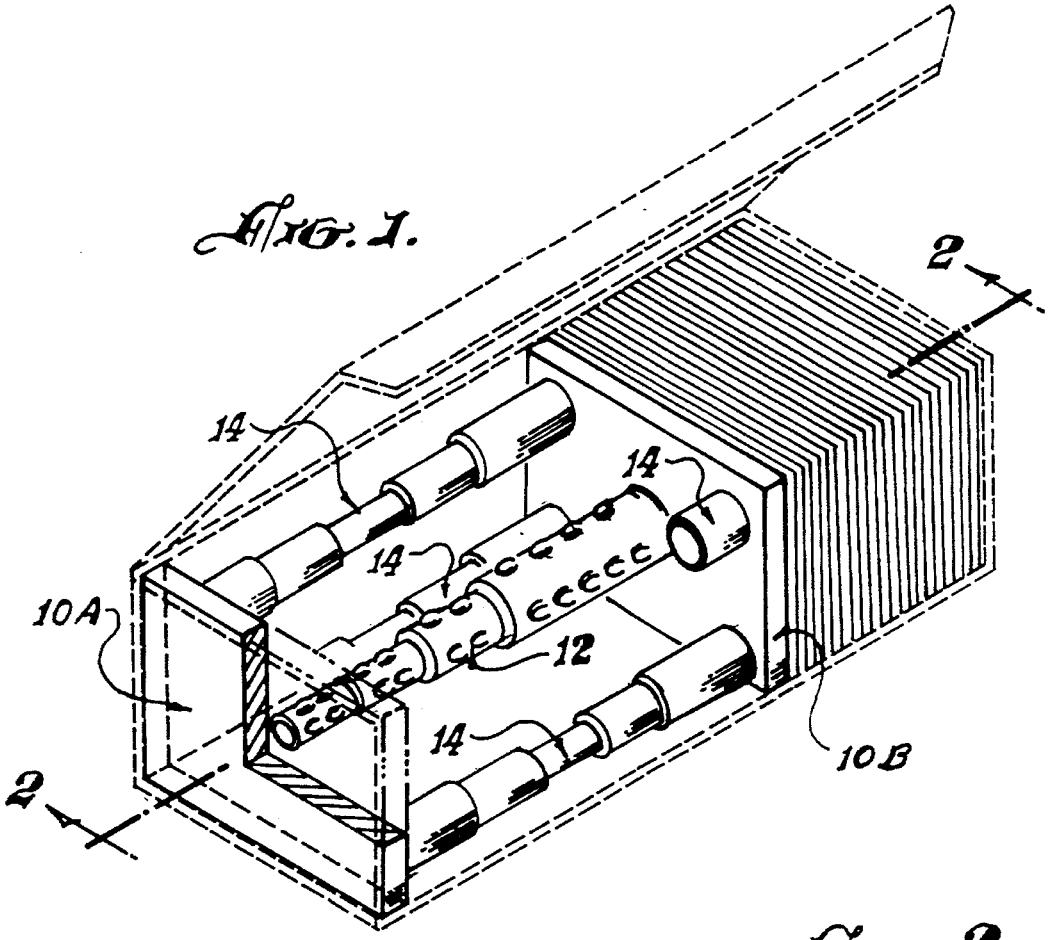
FIG. 1 is an isometric or perspective view of the baseball card storage and protection device, illustrating how the device in an extended position is pressing against the pack of cards inside the box to prevent the cards from moving around and getting damaged.

A typical embodiment of the device of the present invention is illustrated in the isometric or perspective view in FIG. 1. The main elements of the baseball card storage and protection device are the two main end plates 10A and 10B. In the preferred embodiment, these end plates are made of injection molded poly-ethylene plates, measuring 3.5×2.5 inches×¼ inch thick. They may be solid or hollow. Perpendicular to each plate four hollow tubes also of poly-ethylene material,measuring ⅜ of an inch in diameter with a wall thickness of 1/16 of an inch and approx. 1¼ inches long is fastened to each plate on one side and at each corner. Inside these tubes other tubes will fit, measuring 5/16 of an inch in diameter, also 1/16 of an inch wall thickness and 1¼ inches long. Inside these second tubes again another tube will fit measuring ¼ inch in diameter, 1/16 of an inch wall thickness and approximately 2½ inches long. The combination of these five tubes is telescoping, fits snugly together at a close fit and form the guides 14 for the two end plates 10A and 10B. At the center of each end plate 10A and 10B, also perpendicular to plates 10A and 10B the main connector 12 is fastened or welded as the set of guiding tubes 14. The main connector 12 is also made from molded poly-ethylene and consists of five sections of tubing of various diameter, which are also telescoping and measure approximately 2½ inches long. Each section of this main connector 12 is provided with bubbles on the outside surface and recesses or notches at the inside surfaces formed by injection molding, which fit closely and snap together when the set of tubes of this main connector 14 is in the retracted or extended modes.

Figure 2:
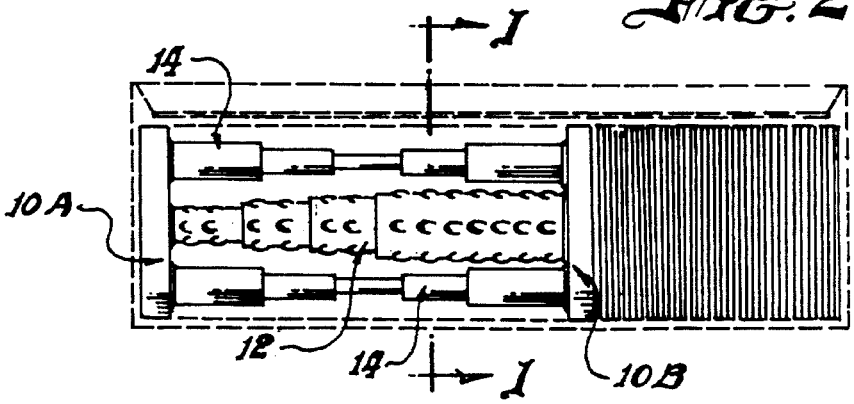
FIG. 2 is a side elevation of the device also illustrating in a different view how the device is protecting the cards inside the standard box from getting damaged.
Figure 3:
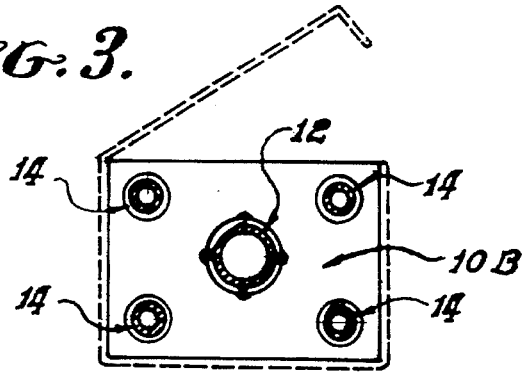
FIG. 3 is a section taken along line 1—1 in FIG. 2.
Figure 5:
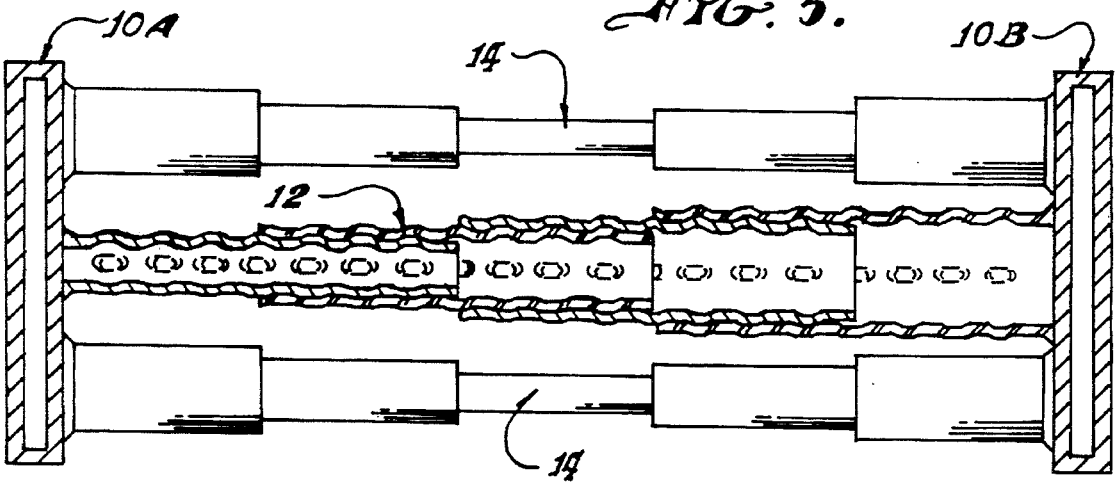
FIG. 5 is also a longitudinal section a longitudinal section along line 2—2 through the device shown in extended position and illustrating how the various parts of the main connector, provided with the molded bubbles and the recesses snap together as needed to be extended or, as in FIG. 4, to be retracted.

In FIGS. 2 and 5, elevations of the preferred embodiment of the device, it will be clear to the reader how the parts of said simple and useful device fit in the extended mode. In said elevations it is clearly illustrated how the end plate 10A on one side is pressing against the end of the storage box. On the other end, the end Plate 10B is shown pressing against the pack of baseball cards.

Figure 4:
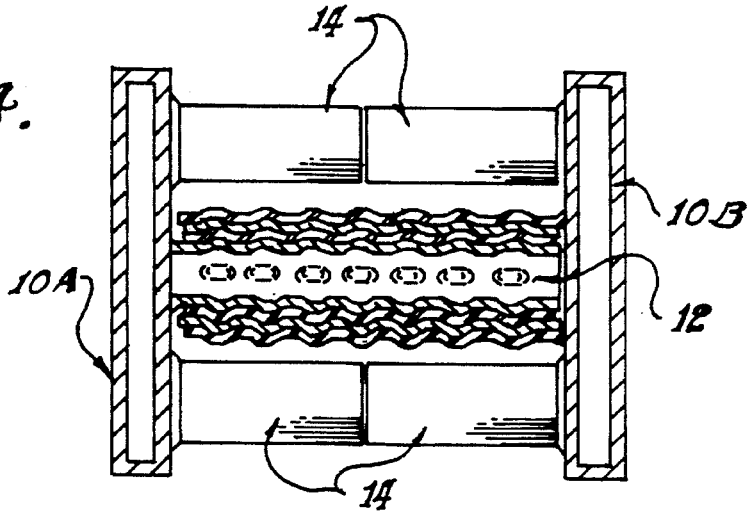
FIG. 4 is an enlarged longitudinal section along line 2—2 through the device shown in retracted position.
Figure 6:
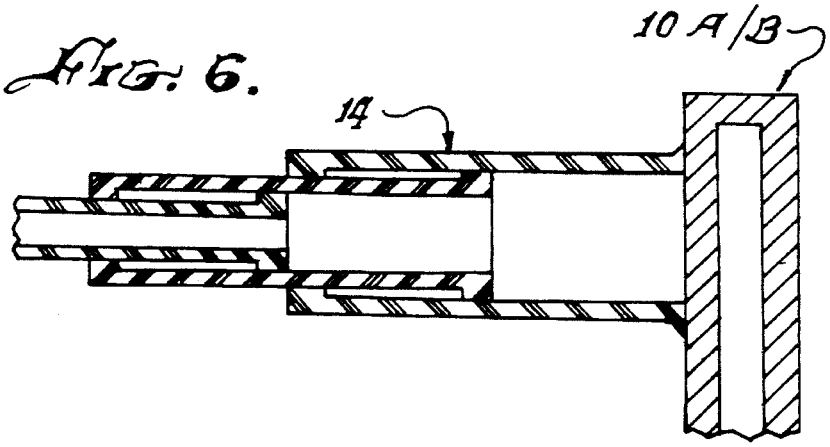
FIG. 6 is a fragmentary section section through some of the telescoping tube guides to illustrate how the tubes are provided with a molded lip or end stop to prevent the device from being taken apart completely.

In FIGS. 4 through 6, more details of the device of the present invention are illustrated, clearly showing how the various parts as the end plates 10A and 10B, the connector guiding telescoping tubes 14 and the main connector tube 12 are put together to make up the entire device in it's preferred embodiment.

OPERATION - FIGS. 1 THROUGH 6

The manner of using the baseball card protection and storage device is very simple. After a pack of baseball cards are put into the standard box for storage or transportation, the device of the present invention is also put inside the box and the two end plates 10A and 10B are simply spread apart until end plate 10A presses firmly against the end of the storage box and the end plate 10B against the pack of cards. During the entire operation the bubbles of the main connector 12 snap snugly into the notches at the inside of the parts of the main connector and stop snapping into notches when the end plate 10B comes to a halt and is firmly pressing against the pack of cards.

SUMMARY, RAMIFICATION AND SCOPE OF THE PRESENT INVENTION

Accordingly, the reader will see, that the Baseball card storage and protection device of this invention can be used to protect the cards of baseball card collection enthusiasts, when the cards are stored and transported inside a standard box used by baseball card manufacturers to transport and store the cards.

Furthermore, the device of the present invention has the additional advantages in that it gives the serious baseball card collector/investor the piece of mind that his cards are safely stored inside the box in a vertical position and pressing securely against each other, so that the chances of getting damaged are eliminated.

the cards are securely stored inside the box so that they are not allowed to move around inside the box, resulting in chances that they could be seriously damaged which could also result in a tremendous financial loss.

It eliminates the necessity of manufacturers and traders of baseball cards to provide various sizes of standard boxes and that one standard box will be sufficient. The largest size standard box could be used for this purpose.

It gives the collector the advantage of having only one size of standard box to store his valuable cards in so that he will not have the disadvantage of a mismatch of boxes for storage and transportation Although the description of the baseball card protection and storage device of the present invention is narrowly specified above, it should not be construed as limiting the scope of the present invention, but merely as providing illustrations of some of the presently preferred embodiment of this invention. For example, the device could be made bigger in size, with larger end plates and an increased number of guiding tubes and main connectors to accomodate comic books or baseball card magazines.

Thus the scope of the invention should be determined by the appended claims and their legal equivalents, rather than by the examples given.

I claim:

1. A protection device for use in a baseball card storage box, comprising:

a first plate and a second plate, each plate having at least four corners, a connector made up of five close fitting, telescoping tubular, parts fitted one part into another and two end parts, each end part perpendicularly fastened to the center of one of said end plates, said connector being extendable and retractable along an axis of said connector when said end plates are pulled away or pushed toward each other, said tubular parts of said connector having an outside and an inside, said outside being provided with molded bubbles on the outside and cavities on the inside into which said bubbles can be snugly positioned to secure said end plates apart at discrete distances when said end plates are pulled apart or pushed together, four telescoping guide tubes connected to said end plates one of said telescoping guide tubes at each of said corners, said telescoping guide tubes being movable longitudinally between an extended position and a retraced position, said telescoping guide tubes being provided with molded annular shoulder stops to prevent the device from being pulled apart.

* * * * *